US006673766B1

(12) United States Patent
Hartshorn et al.

(10) Patent No.: US 6,673,766 B1
(45) Date of Patent: Jan. 6, 2004

(54) SOLID DETERGENT COMPOSITIONS CONTAINING MIXTURES OF SURFACTANT/ BUILDER PARTICLES

(75) Inventors: Richard Timothy Hartshorn, Wylam (GB); Zayeed Alam, West Chester, OH (US); Sylvestre Canceil, Newcastle upon Tyne (GB); Alan Thomas Brooker, Newcastle upon Tyne (GB); Gerard Marcel Baillely, Mason, OH (US); Kevin Norwood, Cincinnati, OH (US); David Scott Bohlen, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/787,448

(22) PCT Filed: Sep. 25, 1998

(86) PCT No.: PCT/US98/20220

§ 371 (c)(1),
(2), (4) Date: Jul. 11, 2001

(87) PCT Pub. No.: WO00/18873

PCT Pub. Date: Apr. 6, 2000

(51) Int. Cl.[7] ..... C11D 1/22; C11D 3/08

(52) U.S. Cl. ..... 510/446; 510/315; 510/323; 510/377; 510/426; 510/438; 510/441; 510/443; 510/444; 510/445; 510/446; 510/450; 510/507; 510/511; 510/532

(58) Field of Search ..... 510/315, 323, 510/377, 426, 444, 438, 441, 443, 445, 446, 450, 507, 511, 532

(56) References Cited

U.S. PATENT DOCUMENTS

| | | | | | |
|---|---|---|---|---|---|
| 4,321,157 | A | * | 3/1982 | Harris et al. | 252/174.25 |
| 4,414,130 | A | * | 11/1983 | Cheng | 252/140 |
| 5,009,804 | A | * | 4/1991 | Clayton et al. | 252/90 |

FOREIGN PATENT DOCUMENTS

| | | | |
|---|---|---|---|
| EP | 0 342 043 A2 | | 11/1989 |
| WO | WO 97/02339 | | 1/1997 |
| WO | 98/01520 | * | 1/1998 |

* cited by examiner

*Primary Examiner*—Charles Boyer
(74) *Attorney, Agent, or Firm*—Julia A. Glazer; Brahm J. Corstanje; Kim W. Zerby

(57) ABSTRACT

The invention relates to detergent compositions comprising from 10–60 wt % of a surfactant system and having a maximum Residues Index of 25 and a maximum Secondary Residues Index of 15. The detergents claim provide good performance in the wash based on the quantities of detergent components in the compositions.

7 Claims, No Drawings

SOLID DETERGENT COMPOSITIONS CONTAINING MIXTURES OF SURFACTANT/ BUILDER PARTICLES

TECHNICAL FIELD

The invention relates to detergent compositions in particular, to laundry detergent compositions.

BACKGROUND

All detergents for laundry applications contain surfactants and builders. Generally, most detergents comprise a base powder made by spray-drying or by granulation of builder components and surfactant components for example, by agglomeration or extrusion. The base powder is often further treated with post-treatment steps such as dry-adding additional particulate detergent components, spray-on of further liquid components such as surfactants, particularly non-ionic surfactants and/or post-dusting steps using finely particulate solid materials to reduce caking and stickiness of the solid detergents produced.

Environmental pressures have led to the need to produce detergents which are as efficient as possible. The trend to use lower amounts of more highly compact detergent compositions, for example having a density above 600 g/l or 650 g/l or above 700 g/l or even higher, has emphasised the need to ensure full performance of all of the detergent components in the wash.

However, solid detergents tend to form lumps or gel upon contact with water. Lumps of gelled material may then fall into the sump of a washing machine where they are not disturbed mechanically, or because of their method of use in a machine, solid detergents do not dissolve, poor delivery of the product from a dispensing drawer of a washing machine or from a dispensing device and/or once in the machine itself results. Poor use of all of the detergent components is therefore achieved.

The inventors have found that in order to overcome this problem a combination of properties is required. This can be achieved by control of the detergent and the detergent making process so that the combinations of different detergent components, when formed into particulates for making finished detergent are modified so that the maximum performance benefit for each of the detergent components is achieved. This results in detergent compositions which have good solubility and minimum gelling and therefore maximum delivery of the detergent components to the wash, for example, by minimising the interaction of some detergent components and maximising the interaction between other detergent components. These benefits lead to good washing performance and minimising of any fabric damage due to high localised bleach concentrations.

SUMMARY OF THE INVENTION

In accordance with the present invention there is provided a solid detergent composition comprising from 10–60 wt % of a surfactant system and having a maximum Residues Index of 25 and a maximum Secondary Residues Index of 15.

The Residues Index can be calculated in the following way:

1 litre of de-ionised water is placed in a tergitometer (Erweka DT6-R hereinafter referred to as the 'Sotax' apparatus) (USP 711 dissolution standard). The Sotax is fitted with a perspex lid to prevent evaporation, it is calibrated to a temperature of 5° C. with the stirrer (paddle) set to 200 rpm. The paddle has two blades fixed at the central axis directly opposite one another so that overall the two blades provide the paddle with a diameter of 75 mm. The paddle is positioned in the centre of the Sotax apparatus with a distance between the bottom of the paddle and the bottom of the tergitometer of 25 mm. The overall height of the paddle blades is 19 mm. A wire basket is provided having side walls and base formed from 20 mesh (850 $\mu$) stainless steel wire, a diameter of 25 mm and a height of 41 mm. The wire basket is filled with a detergent product, the surface of the detergent product is levelled off and a non-permneable lid is used to close off the top of the wire basket. The wire basket is then suspended in a stationary position midway between the central axis of the Sotax and the side wall, at a height such that the base of the wire basket is 7 mm above the upper surface of the paddle.

After twelve minutes the wire basket assembly is removed from the Sotax apparatus and the residue is removed to a pre-weighed container. The transfer step must be quantitative; a rinsing step with de-ionised water is acceptable if needed. The residues are oven dried at 70–80° C. until no further weight loss is recorded. The dry residue weight is recorded. The percentage residue from the basket as a proportion of the mass of the initial sample of the detergent composition which was placed into the Sotax is then calculated. An average of the percentage residue remaining for two identical samples provides the Residues Index number.

The Residues Index for the detergent compositions of the invention must be no greater than 25, preferably being no greater than 20, even more preferably being no greater than 15.

The Secondary Residues Index is calculated in the following way:

Using the same apparatus, 800 ml of de-ionised water is charged to the Sotax apparatus and the temperature is allowed to equilibrate to 20° C. with a stirrer speed of 200 rpm. 2 grammes of product is then added to the de-ionised water and stirred at a stirrer speed of 200 rpm for 20 minutes. After 20 minutes, the de-ionised water containing the detergent sample is filtered through a C70 black fabric circle (from Empirical Manufacturing Company) placed in a Buchner funnel with the smooth side of the fabric uppermost. The black fabric is removed from the Buchner funnel and placed on a sheet of paper. The black fabric is allowed to dry at ambient temperature for 24 hours. Three replicates are obtained for each test and an average of the percent residue remaining on the black fabric circle as a proportion of the total detergent sample charged to the Sotax, is calculated.

The average residues from the three replicates provide the Secondary Resides Index number, which must be a maximum of 15. Preferably, the maximum Secondary Residues Index is 10, even more preferably, the maximum Secondary Residues Index may be 5 or less.

Builder System

The detergent compositions comprise a builder system which may be provided by one or mixtures of more than one builder. Water soluble and/or water insoluble builders may be used. The builder system generally comprises from 1 to 90 wt % of the detergent composition, preferably from 20 to 80 wt % of the composition.

Water-soluble or Partially Water-soluble Builders

The builder system in the compositions according to the invention preferably contains a water-soluble and/or partially water-soluble builder compound, typically present at a level of from 1% to 80% by weight, preferably in amounts up to 50 wt %, or up to 40% or even 35%. Preferably water-soluble builders are present in amounts from at least 3% or 8%, but they are preferably present in amounts from 6 to 25 wt %.

The detergent compositions of the invention may comprise phosphate-containing builder material, such as tetrasodium pyrophosphate or more preferably anhydrous sodium tripolyphosphate. Phosphate builders may be present at a level of from 0.5% to 60%, or from 5% to 50%, or even from 8% to 40% by weight. However, it is generally preferred that the compositions are free of phosphate-containing builder material.

Crystalline layered silicates are also suitable partially water-soluble builders. The preferred crystalline layered silicate herein has the general formula $$NaMSi_xO_{2x+1},yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. M is preferably H, K or Na or mixtures thereof, preferably Na. The most preferred material is $\alpha$-$Na_2Si_2O_5$, $\beta$-$Na_2Si_2O_5$ or $\delta$-$Na_2Si_2O_5$, or mixtures thereof, preferably being at least 75% -$Na_2Si_2O_5$, for example available from Clariant as NaSKS-6. The crystalline layered silicate material, in particular of the formula $Na_2Si_2O_5$ may optionally comprise other elements such as B, P, S, for example obtained by processes as described in EP 578986-B.

Partially water-soluble builder is preferably present at a level up to 40%, more preferably up to 35%. When present it may be preferred that the composition of the invention comprises from 10% to 40%, more preferably from 12% to 35% or even from 15% to 25% by weight of the composition of the partially water-soluble builder.

The water soluble builders include organic carboxylic acids and salts thereof. Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms and mixtures of any of the foregoing.

The carboxylate or polycarboxylate builder can be momomeric or oligomeric in type although monomeric polycarboxylates are generally preferred for reasons of cost and performance. In addition-to these water-soluble builders, polymeric polycarboxylates may be present, including homo and copolymers of maleic acid and acrylic acid and their salts.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid, malic and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates. The parent acids of the monomeric or oligomeric polycarboxylate chelating agents or mixtures thereof with their salts, e.g. citric acid or citrate/citric acid mixtures, are also contemplated as useful builder components.

Most preferred may be acetic acid, citric acid, malic acid, and fumaric acid, or their salts or mixtures thereof. It may be preferred that mixtures of the salt and acid form are present.

The water soluble builder is preferably present at a level up to 40%, more preferably up to 35%. When present it may be preferred that the composition of the invention comprises from 10% to 40%, more preferably from 12% to 35% or even from 15% to 25% by weight of the composition of the water-soluble builder.

It may be preferred that the polymeric or oligomeric polycarboxylates are present at levels of less than 5%, preferably less than 3% or even less than 2% or even 0% by weight of the compositions.

Borate builders, as well as builders containing borate-forming materials that can produce borate under detergent storage or wash conditions are useful water-soluble builders herein.

Other suitable water-soluble builder materials are polymeric polycarboxylic acids or polycarboxylates, including the water soluble homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–50000, preferably 10000 or even 7000 and copolymers of (poly)acrylate and maleic acid or anhydride, such copolymers having preferably a molecular weight of from 2000 to 100,000, especially 40,000 to 80,000.

In a preferred embodiment of the invention, the water-soluble or partially insoluble builder, and in particular, crystalline layered silicate when present, is at least partially, for example at least 50 wt % present, in an intimate mixture with a surfactant, preferably an anionic surfactant.

It has also been found that when the highly water-soluble carboxylate- or carboxylic acid-containing compounds are present in an intimate mixture with one or more of the surfactants and optionally other ingredients, the rate of dissolution of the intimate mixture and also of the surfactants and other ingredients is increased. Thus, overall a faster delivery of the surfactants and other ingredients can be achieved.

Thus, a preferred particulate component in the detergent compositions of the invention herein may comprise an intimate mixture of preferably from 25% to 75% by weight, more preferably from 35% to 68%, even more preferably from 45% to 62% by weight of the component of a of a crystalline layered silicate or water-soluble builder and from 25% to 75% by weight, more preferably from 32% to 62% by weight more preferably from 38% to 48% by weight of the component of an anionic surfactant.

Such a particulate component preferably comprises less than 10% by weight of free moisture, preferably less than 5%, or even less than 3% or even less than 2% by weight. The free moisture content as used herein, can be determined by placing 5 grams of the particulate component in a petri dish and placing this petri dish in a convection oven at 50° C. for 2 hours, and subsequently measuring the weight loss, due to water evaporation The anionic surfactant preferably comprises from 50% to 100% by weight, preferably from 60% or even 75% to 100% of the anionic surfactant of a sulphonate surfactant preferably an alkyl benzene sulphonate surfactant, as described below. As much as 50% by weight or more based on the total amount of anionic surfactant in the detergent composition is preferably incorporated into such a particulate component.

Preferably such a particulate component is present in the detergent composition in amounts of from 0.5 to 60 wt %, preferably from 3% to 50%, more preferably from 5% to 45%, even more preferably at a level of at least 7% by weight of the composition.

Preferably, the weight ratio of the crystalline layered silicate and/or one or more water-soluble builders to the anionic surfactant in the intimate mixture is from 4:5 to 7:3, more preferably from 1:1 to 2:1, most preferably from 5:4 to 3:2.

Such a component may also comprise additional ingredients, for example in amounts of from 0% to 25%, generally no greater than 20% or even 15% by weight of the particulate component. The precise nature of these additional ingredients, and levels of incorporation thereof will depend on the application of the component or compositions and the physical form of the components and the compositions. It may be preferred that the particulate composition comprises less than 15% or even less 10% or even 5% by weight of the granulate of non-ionic ethoxylated alcohol surfactant, preferably less than 15%, or even less than 10% or even less than 5% of any non-ionic surfactant.

It may be preferred that the particulate composition comprises less than 10% by weight, preferably less than 5% by weight of an aluminosilicate material. If any aluminosilicate material is present, it may be preferred that the particulate composition is dusted with the aluminosilicate material.

The particulate component may comprise polymeric binder material, although it is preferred to use as little binder material as possible. It may be preferred that the intimate mixture comprises less than 25%, preferably less than 10%, more preferably less than 5% by weight, most preferably 0% by weight of ethylene oxide polymers.

The particulate component preferably has a weight average particle size of at least 50 microns, preferably from 150 microns to 1500 microns, or more preferably 80% by weight of the particles has an particle size of more than 300 microns (80% by weight on Tyler sieve mesh 48) and less than 10% by weight of the particles has a particle size of more than 1180 microns or even 710 microns (on Tyler mesh sieve24).

Preferably, the density of the particulate component is from 380 g/litre to 1500 gr/litre, or more preferably from 500 g/litre to 1200 g/litre, more preferably from 550 g/litre to 900 g/litre.

The particulate component can be present in the detergent compositions of the invention as a separate particle, or it may be further mixed with other detergent ingredients, including by further agglomeration, compaction, tabletting or extrusion.

Such an intimate mixture or particulate component may be prepared by any well-known method for forming such detergent particulates e.g. agglomeration, spray-drying, roll compaction and/or extrusion or combinations of these process steps. Such processes may optionally be followed by a drying step or a dusting step and/or a spray-on step. The granulate produced is then preferably mixed with the other detergent ingredients.

The crystalline layered silicate and/or highly water-soluble builder may also be in an intimate mixture with other materials, including one or more of the water-soluble builders or polymeric compounds such as acrylic and/or maleic acid polymers, inorganic acids or salts, including carbonates and sulphates, or small levels of other silicate material, including amorphous silicate, meta silicates, and aluminosilicates, as described herein.

It may be preferred that part or even all of the water-soluble builder, in particular, monomeric or oligomeric (poly)carboxylic acid or salt thereof is in the form of a separate particle, whereby it may be preferred that the average particle size of this builder material is then preferably less than 150 microns, or even less than 100 microns. It may be preferred that part of the water-soluble or partially water-soluble builder is used as dusting agent, to reduce the caking of the product when necessary.

In particular, when small amounts of insoluble builder are present in the compositions a polycarboxylate polymer, such as polymer and copolymer of maleic anhydride or acid and (poly)acrylic acid and their salts may be incorporated at a level of from 0.5% to 15%, preferably from 1% to 12% or even from 2% to 8% by weight of the composition. Hereby, it may be preferred that the water-insoluble builder and the polymer are not in an intimate mixture with one another.

The inventors have also found that when a polymeric polycarboxylate is present, it may be preferred that the polymer is comprised in an intimate mixture with other detergent components, preferably in a spray-dried particle, which is prepared by first mixing a carbonate salt and the polymer and then addition and intimately mixing of other ingredients.

Insoluble Builders

The compositions of the invention may contain an insoluble builder compound. Generally these are present in amounts no more than 30 wt % based on the detergent composition as a whole, preferably no greater than 25 wt %.

Examples of largely water insoluble builders include the sodium aluminosilicates.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276 H_2O$.

Another preferred aluminosilicate zeolite is zeolite MAP builder. Zeolite MAP is described in EP 384070A (Unilever). It is defined as an alkali metal aluminosilicate of the zeolite P type having a silicon to aluminium ratio not greater than 1.33, preferably within the range from 0.9 to 1.33 and more preferably within the range of from 0.9 to 1.2. Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres. The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Water insoluble-builders, in particular aluminosilicates, have been found to contribute to the problems of poor overall use of components of detergent compositions. Therefore, their incorporation into detergent compositions is generally at low levels, or requires specific processing to enable maximum efficiency of all the detergent ingredients in a detergent composition.

Thus, in one embodiment of the invention, aluminosilicate builder is preferably present in amounts below 9 wt %, preferably below 6 wt % or 4 wt %. It may even be preferred that substantially no water-insoluble builder is present. Preferably a detergent composition will contain low levels of amorphous silicates, for example less than 5 wt % of the composition of amorphous sodium silicate, most preferably less than 2 wt %.

In a preferred aspect the detergent composition preferably comprises a builder system which comprises less than 30% or even less than 20% or even less than 10% by weight of water insoluble builder, whereby in the preferred embodiments the balance of the builder system are the water-soluble builders and/or partially water soluble builders.

When present, the aluminosilicate may be contained in a component containing other detergent ingredients, such as surfactants for example, in a detergent agglomerate, extrudate or a blown powder. It may even be preferred that substantially no aluminosilicate is present as a separate (dry-added) particulate ingredient.

Also, preferably less than 3% or even less than 1.5% or even less than 0.8% by weight of amorphous silicate is present. When present, the amorphous silicate is preferably contained in a component containing other detergent ingredients, such as surfactant for example, in a detergent agglomerate, extrudate or a blown powder. It may be preferred that substantially no amorphous silicate is present as separate particulate ingredient.

As described above, detergent compositions of the invention preferably comprise at least one particulate component containing an intimate mixture of one or more of the water soluble or partially water soluble builders and one or more surfactants. Preferably, at least two of such particulate components are present in the detergent composition.

In a further embodiment of the invention, if it is desired to incorporate insoluble builder, particularly aluminosilicates in amounts of, for example, 5 wt % or more where the compositions also comprise anionic surfactant for example, in amounts of 5 wt % or more, the detergent composition is preferably such that there are at least two detergent (n) components (i) in the composition and the degree of mixing (M) or the anionic surfactant and aluminosilicate builder is from 0 to 0.7 where $$M=\Sigma_{i=1}^{n}\sqrt{(\sigma_i.\zeta_i)}$$

and $\sigma$ is the fraction of the anionic surfactant of the composition comprised in the component (i);

$\zeta$ is the fraction of the aluminosilicate of the composition comprised in component (i).

In order to achieve particularly good detergent delivery, it is preferred that M is from 0 to 0.6, or even from 0 to 0.5.

In such an embodiment of the invention, the detergent composition herein comprises at least two multi-ingredient (i.e. no more than 95 wt % of a single ingredient in each component) components which comprise an anionic surfactant or an aluminosilicate or mixtures thereof, whereby if mixtures of aluminosilicate and the surfactant are present in one or more of the components, the degree of mixture M is less than 0.7, as defined by the formula. Thus, each component comprises part or all of the aluminosilicate, all or part of the anionic surfactant or mixtures thereof, provided that M is from 0 to 0.7.

The components together comprise the aluminosilicate builder at a level of least 5% by weight of the composition of and the anionic surfactant at a level of at least 5% by weight of the composition. Preferably, the components comprise the aluminosilicate at a level of at least 7%, or more preferably at least 10% or even 15% by weight of the composition. Depending on the precise formulation of the composition and the conditions of use, the compositions of the invention can even comprise higher levels of aluminosilicate, such as more than 20% or even more than 25%, whilst still providing an improved delivery of the detergent to the wash.

Preferably at least 7% or more preferably at least 10% or even at least 12% by weight of the composition of anionic surfactant is present in the components. Depending on the precise formulation of the composition and the conditions of use, it may be preferred to have levels of anionic surfactants of 18% by weight of the composition or more.

Such components are prepared as described above: by any granulation method such as agglomeration, co-compaction, spray-drying or extrusion.

Effervescence System

Any effervescence system known in the art can be used in the detergent compositions of the invention. A preferred effervescence system for incorporation in the particle of the invention, comprises an acid source, capable of reacting with an alkali source in the presence of water to produce a gas.

Preferably, where the effervescence system comprises two or more reactants, these will be provided in an intimate mixture as an effervescence component. Most preferably, the effervescence component comprises an intimate mixture of substantially anhydrous stabilising agent with acid and alkaline reactants.

The acid source component may be any organic, mineral or inorganic acid, or a derivative thereof, or a mixture thereof. Preferably the acid source component comprises an organic acid. The acid source is preferably substantially anhydrous or non-hygroscopic and the acid is preferably water-soluble. It may be preferred that the acid source is overdried. Suitable acid source components include citric, malic, maleic, fumaric, aspartic, glutaric, tartaric succinic or adipic acid, monosodium phosphate, boric acid, or derivative thereof. Citric acid, maleic or malic acid are especially preferred.

Most preferably, the acid source provides acidic compounds which have an average particle size in the range of from about 75 microns to 1180 microns, more preferably from 150 microns to about 710 microns, calculated by sieving a sample of the source of acidity on a series of Tyler sieves.

As discussed above, the effervescence system preferably comprises an alkali source, however, for the purpose of the invention, it should be understood that the alkali source may be part of the effervescence particle or can be part of the cleaning composition comprising the particle, or can be present in the washing liquor, whereto the particle or the cleaning composition is added.

Any alkali source which has the capacity to react with the acid source to produce a gas may be present in the particle, which may be any gas known in the art, including nitrogen oxygen and carbondioxide gas. Preferred can be perhydrate bleaches, including perborate, and silicate material. The alkali source is preferably substantially anhydrous or non-hydroscopic. It may be preferred that the alkali source is overdried.

Preferably this gas is carbon dioxide, and therefore the alkali source is a preferably a source of carbonate, which can be any source of carbonate known in the art. In a preferred embodiment, the carbonate source is a carbonate salt. Examples of preferred carbonates are the alkaline earth and alkali metal carbonates, including sodium or potassium carbonate, bicarbonate and sesqui-carbonate and any mixtures thereof with ultra-fine calcium carbonate such as are disclosed in German Patent Application No. 2,321,001 published on Nov. 15, 1973. Alkali metal percarbonate salts are also suitable sources of carbonate species, which may be present combined with one or more other carbonate sources.

The carbonate and bicarbonate preferably have an amorphous structure. The carbonate and/or bicarbonates may be coated with coating materials. It can be preferred that the particles of carbonate and bicarbonate can have a mean particle size of 75 microns or preferably 150 $\mu$m or greater, more preferably of 250 $\mu$m or greater, preferably 500 $\mu$m or greater. It may be preferred that the carbonate salt is such that fewer than 20% (by weight) of the particles have a particle size below 500 $\mu$m, calculated by sieving a sample of the carbonate or bicarbonate on a series of Tyler sieves. Alternatively or in addition to the previous carbonate salt, it may be preferred that the fewer than 60% or even 25% of the particles have a particle size below 150 $\mu$m, whilst fewer than 5% has a particle size of more than 1.18 mm, more preferably fewer than 20% have a particle size of more than 212 $\mu$m, calculated by sieving a sample of the carbonate or bicarbonate on a series of Tyler sieves.

The molecular ratio of the acid source to the alkali source present in the particle core is preferably from 50:1 to 1:50, more preferably from 20:1 to 1:20 more preferably from 10:1 to 1:10, more preferably from 5:1 to 1:3, more preferably from 3:1 to 1:2, more preferably from 2:1 to 1:2.

Stabilising Agent

The preferred stabilising agents are substantially anhydrous stabilising agent. The stabilising agent can comprise one or more components. It can be preferred that the stabilising agent comprises compounds which are, at least partially, water-soluble.

Preferably, the stabilising agent is solid under normal storage conditions, e.g. the component preferably has a melting point above 30° C., more preferably above 45° C., or even more preferably above 50° C. and it may be preferred that the stabilising agent is such that it readily forms a melt above 80° C.

Preferably, the stabilising agent comprises one or more components, selected from the group comprising alkoxylated alcohols, including polyethylene and/or propylene glycols, and alkoxylated alcoholamides, including ethanolamides, alkoxylated ethanol amides, alkoxylated fatty acid amides or ethanolamides and specific non-ionic surfactants, including (polyhydroxy) fatty acid amides, alkoxylated alcohol surfactants and specific alkylpolysaccharides surfactant, and mixtures of any of these compounds, as described herein.

Preferably, one or more of the components comprised in the stabilising agent are a detergent active which can contribute to the cleaning performance of the particle or the cleaning composition comprising the particle. Highly preferred substantially anhydrous components suitable in the stabilising agent of the particle of the invention, are one or more non-ionic surfactant, selected from the group of non-ionic alkoxylated surfactants, including alkoxylated alcohol surfactants, polyhydroxyfattyacid amide surfactants, fatty acid amide surfactants, alkoxylated fatty acid amides, alkyl esters of fatty acids and alkylpolysaccharide surfactants, and mixtures thereof, as described herein after.

In a highly preferred aspect of the invention, the stabilising agent comprises a mixture of polyhydroxy fatty acid amides and/or polyethylene glycols, and/or alkoxylated fatty acid amides and/or condensation products of aliphatic alcohols with from 1 to 15, or more preferably 11, moles of alkylene oxide, as described in more detail below in the description of suitable surfactants. When present, the ratio of the polyhydroxy fatty acid amides to the condensation products of aliphatic alcohols is preferably from 20:1 to 1:20, more preferably from 10:1 to 1:10, more preferably from 8:1 to 1:8, more preferably from 6:1 to 1:6, most preferably from 2:1 to 1:3. When present, the ratio of the polyhydroxy fatty acid amides to the polyethylene glycol is preferably from 20:1 to 1:8, more preferably from 15:1 to 1:3, more preferably from 12:1 to 1:1, more preferably from 10:1 to 1:1. When present, the ratio of the polyhydroxy fatty acid amides to the alkoxylated fatty acid amides is preferably from 20:1 to 1:20, more preferably from 15:1 to 1:1O, more preferably from 10:1 to 1:10.

Surfactants Suitable for use in the Detergent Composition

The detergent compositions of the invention can contain one or more surfactants selected from anionic, cationic, ampholytic, amphoteric and zwitterionic surfactants or non-ionic surfactants as described below, and mixtures thereof.

A typical listing of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981. Some examples are given below.

Anionic Surfactant

Any anionic surfactant can be incorporated in the compositions of the invention. The anionic surfactant herein preferably comprises at least a sulphate surfactant and/or a sulphonate surfactant or mixtures thereof. It may be preferred that the anionic surfactant comprises only alkyl sulphonate surfactant or optionally combined with fatty acids or soap salts thereof. Alternatively, it may be preferred that the composition comprises only akly sulphate surfactant, but hereby it is preferred that at least a mid-chain branched alkyl surfactant is present or at least two alkyl surfactants are present.

Depending on the precise formulation of the composition and the use thereof, it may be preferred that the compositions herein comprise a particulate component, as descriebd above, preferably in the form of a flake of an alkyl sulfate or sulphonate surfactant, preferably an alkyl benzene sulphonate, present at a concentration of from 85% to 95% of the particle or flake, the balance being an sulfate salt and moisture, the particle or flake being admixed to the other detergent component(s) or ingredients.

Other possible anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Depending on the precise formulation of the composition and the use thereof, it may be preferred that the compositions herein comprise a component which contains high levels of an alkyl sulphate or sulphonate surfactant or mixtures thereof, preferably an alkyl benzene sulphonate, intimately mixed with an sulphate salt and moisture. For example, such a component comprising from 85% to 95% of one an anionic sulphate or sulphonate surfactant and from 15% to 5% sulphate salt and moisture. Such a component may be in the form f a flake, which can be admixed or dry-added to the other components of the detergent composition herein.

Anionic Sulphonate Surfactant

The anionic sulphonate surfactants in accordance with the invention include the salts of $C_5$–C20 linear or branched alkylbenzene sulphonates, alkyl-ester sulphonates, $C_6$–$C_{22}$ primary or secondary alkane sulphonates, $C_6$–$C_{24}$ olefin sulphonates, sulphonated polycarboxylic acids, and any mixtures thereof.

Highly preferred is a C12–C16 linear alkylbenzene sulphonate. Preferred salts are sodium and potassium salts.

The alkyl ester sulphonated surfactant are also suitable for the invention, preferably those of formula $$R^1—CH(SO_3M)—(A)_x—C(O)—OR^2$$

wherein $R^1$ is a $C_6$–$C_{22}$ hydrocarbyl, $R^2$ is a $C_1$–$C_6$ alkyl, A is a $C_6$–$C_{22}$ alkylene, alkenylene, x is 0 or 1, and M is a cation. The counterion M is preferably sodium, potassium or ammonium.

The alkyl ester sulphonated surfactant is preferably a α-sulpho alkyl ester of the formula above, whereby thus x is 0. Preferably, $R^1$ is an alkyl or alkenyl group of from 10 to 22, preferably 16 C atoms and x is preferably 0. $R^2$ is preferably ethyl or more preferably methyl.

It can be preferred that the R1 of the ester is derived from unsaturated fatty acids, with preferably 1, 2 or 3 double bonds. It can also be preferred that $R^1$ of the ester is derived from a natural occurring fatty acid, preferably palmic acid or stearic acid or mixtures thereof.

Anionic Alkyl Sulphate Surfactant

The anionic sulphate surfactant herein include the linear and branched primary and secondary alkyl sulphates and disulphates, alkyl ethoxysulphates having an average ethoxylation number of 3 or below, fatty oleoyl glycerol sulphates, alkyl phenol ethylene oxide ether sulphates, the $C_5$–$C_{17}$ acyl—N—($C_1$–$C_4$ alkyl) and —N—($C_1$–$C_2$ hydroxyalkyl) glucamine sulphates, and sulphates of alkylpolysaccharides.

Primary alkyl sulphate surfactants are preferably selected from the linear and branched primary $C_{10}$–$C_{18}$ alkyl sulphates, more preferably the $C_{11}$–$C_{15}$ linear or branched chain alkyl sulphates, or more preferably the $C_{12}$–$C_{14}$ linear chain alkyl sulphates.

Preferred secondary alkyl sulphate surfactant are of the formula $$R^3—CH(SO_4M)—R^4$$

wherein $R^3$ is a $C_8$–$C_{20}$hydrocycarbyl, $R^4$ is a hydrocycarbyl and M is a cation.

Alkyl ethoxy sulphate surfactants are preferably selected from the group consisting of the $C_{10}$–$C_{18}$ alkyl sulphates which have been ethoxylated with from 0.5 to 3 moles of ethylene oxide per molecule. More preferably, the alkyl ethoxysulphate surfactant is a $C_{11}$–$C_{18}$, most preferably $C_{11}$–$C_{15}$ alkyl sulphate which has been ethoxylated with from 0.5 to 3, preferably from 1 to 3, moles of ethylene oxide per molecule.

A particularly preferred aspect of the invention employs mixtures of the preferred alkyl sulphate and alkyl ethoxysulphate surfactants. Preferred salts are sodium and potassium salts.

Mid-chain Branched Anionic Surfactants

Preferred mid-chain branched primary alkyl sulfate surfactants for use herein are of the formula $$CH_3CH_2(CH_2)_wCH(R)(CH_2)_xCH(R^1)(CH_2)_yCH(R^2)(CH_2)_zOSO_3M$$

These surfactants have a linear primary alkyl sulfate chain backbone (i.e., the longest linear carbon chain which includes the sulfated carbon atom) which preferably comprises from 12 to 19 carbon atoms and their branched primary alkyl moieties comprise preferably a total of at least 14 and preferably no more than 20, carbon atoms. In the surfactant system comprising more than one of these sulfate surfactants, the average total number of carbon atoms for the branched primary alkyl moieties is preferably within the range of from greater than 14.5 to about 17.5. Thus, the surfactant system preferably comprises at least one branched primary alkyl sulfate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

R, $R^1$, and $R^2$ are each independently selected from hydrogen and $C_1$–$C_3$ alkyl group (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

M is hydrogen or a salt forming cation depending upon the method of synthesis. w is an integer from 0 to 13; x is an integer from 0 to 13; y is an integer from 0 to 13; z is an integer of at least 1; and w+x+y+z is an integer from 8 to 14.

A preferred mid-chain branched primary alkyl sulfate surfactant is, a C16 total carbon primary alkyl sulfate surfactant having 13 carbon atoms in the backbone and having 1, 2, or 3 branching units (i.e., R, $R^1$ and/or $R^2$) of in total 3 carbon atoms, (whereby thus the total number of carbon atoms is at least 16). Preferred branching units can be one propyl branching unit or three methyl branching units.

Another preferred surfactant are branched primary alkyl sulfates having the formula

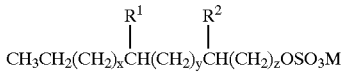

wherein the total number of carbon atoms, including branching, is from 15 to 18, and when more than one of these sulfates is present, the average total number of carbon atoms in the branched primary alkyl moieties having the above formula is within the range of greater than 14.5 to about 17.5; $R^1$ and $R^2$ are each independently hydrogen or $C_1$–$C_3$ alkyl; M is a water soluble cation; x is from 0 to 11; y is from 0 to 11; z is at least 2; and x+y+z is from 9 to 13; provided $R^1$ and $R^2$ are not both hydrogen.

Dianionic Surfactants

The dianionic surfactants are also useful anionic surfactants for the present invention, in particular those of formula

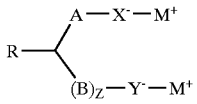

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A nad B are independently selected from alkylene, alkenylene, (poly) alkoxylene, hydroxyalkylene, arylalkylene or amido alkylene groups of chain length $C_1$ to $C_{28}$ preferably $C_1$ to $C_5$, most preferably $C_1$ or $C_2$, or a covalent bond, and preferably A and B in total contain at least 2 atoms; A, B, and R in total contain from 4 to about 31 carbon atoms; X and Y are anionic groups selected from the group comprising carboxylate, and preferably sulfate and sulfonate, z is 0 or preferably 1; and M is a cationic moiety, preferably a substituted or unsubstituted ammonium ion, or an alkali or alkaline earth metal ion.

The most preferred dianionic surfactant has the formula as above where R is an alkyl group of chain length from $C_{10}$ to $C_{18}$, A and B are independently $C_1$ or $C_2$, both X and Y are sulfate groups, and M is a potassium, ammonium, or a sodium ion.

Preferred dianionic surfactants herein include:

(a) 3 disulphate compounds, preferably 1,3 C7–C23 (i.e., the total number of carbons in the molecule) straight or branched chain alkyl or alkenyl disulphates, more preferably having the formula:

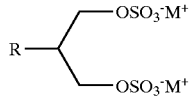

wherein R is a straight or branched chain alkyl or alkenyl group of chain length from about $C_4$ to about $C_{20}$;

(b) 1,4 disulphate compounds, preferably 1,4 C8–C22 straight or branched chain alkyl or alkenyl disulphates, more preferably having the formula:

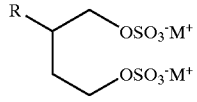

wherein R is a straight or branched chain alkyl or alkenyl group of chain length from about $C_4$ to about $C_{18}$; preferred R are selected from octanyl, nonalyl, decyl, dodecyl, tetradecyl, hexadecyl, octadecyl, and mixutres thereof, and (c) 1,5 disulphate compounds, preferably 1,5 C9–C23 straight or branched chain alkyl or alkenyl disulphates, more preferably having the formula:

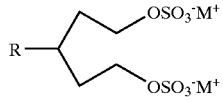

wherein R is a straight or branched chain alkyl or alkenyl group of chain length from about $C_4$ to about $C_{18}$.

It can be preferred that the dianionic surfactants of the invention are alkoxylated dianionic surfactants.

The alkoxylated dianionic surfactants of the invention comprise a structural skeleton of at least five carbon atoms, to which two anionic substituent groups spaced at least three atoms apart are attached. At least one of said anionic substituent groups is an alkoxy-linked sulphate or sulphonate group. Said structural skeleton can for example comprise any of the groups consisting of alkyl, substituted alkyl, alkenyl, aryl, alkaryl, ether, ester, amine and amide groups. Preferred alkoxy moieties are ethoxy, propoxy, and combinations thereof.

The structural skeleton preferably comprises from 5 to 32, preferably 7 to 28, most preferably 12 to 24 atoms. Preferably the structural skeleton comprises only carbon-containing groups and more preferably comprises only hydrocarbyl groups. Most preferably the structural skeleton comprises only straight or branched chain alkyl groups.

The structural skeleton is preferably branched. Preferably at least 10% by weight of the structural skeleton is branched and the branches are preferably from 1 to 5, more preferably from 1 to 3, most preferably from 1 to 2 atoms in length (not including the sulphate or sulphonate group attached to the branching).

A preferred alkoxylated dianionic surfactant has the formula

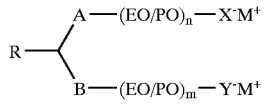

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A and B are independently selected from, optionally substituted, alkyl and alkenyl group of chain length $C_1$ to $C_{28}$, preferably $C_1$ to $C_5$, most preferably $C_1$ or $C_2$, or a covalent bond; EO/PO are alkoxy moieties selected from ethoxy, propoxy, and mixed ethoxy/propoxy groups, wherein n and m are independently within the range of from about 0 to about 10, with at least m or n being at least 1; A and B in total contain at least 2 atoms; A, B, and R in total contain from 4 to about 31 carbon atoms; X and Y are anionic groups selected from the group consisting of sulphate and sulphonate, provided that at least one of X or Y is a sulfate group; and M is a cationic moiety, preferably a substituted or unsubstituted ammonium ion, or an alkali or alkaline earth metal ion.

The most preferred alkoxylated dianionic surfactant has the formula as above where R is an alkyl group of chain length from $C_{10}$ to $C_{18}$, A and B are independently $C_1$ or $C_2$, n and m are both 1, both X and Y are sulfate groups, and M is a potassium, ammonium, or a sodium ion.

Preferred alkoxylated dianionic surfactants herein include: ethoxylated and/or propoxylated disulphate compounds, preferably C10–C24 straight or branched chain alkyl or alkenyl ethoxylated and/or propoxylated disulphates, more preferably having the formulae:

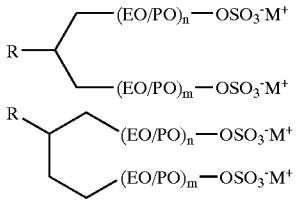

and wherein R is a straight or branched chain alkyl or alkenyl group of chain length from about C6 to about $C_{18}$; EO/PO are alkoxy moieties selected from ethoxy, propoxy, and mixed ethoxy/propoxy groups; and n and m are independently within the range of from about 0 to about 10 (preferably from about 0 to about 5), with at least m or n being 1.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressors.

Alkali Metal Sarcosinate Surfactant

Other suitable anionic surfactants are the alkali metal sarcosinates of formula $R—CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Non-ionic Alkoxylated Surfactants

When non-ionic surfactants are present, it may be preferred that the components of the compositors herein are free of sprayed-on non-ionic alkoxylated alcohol surfactants. It has been found that hereby the delivery of the composition to the washing water can be improved and the caking of the product can be reduced. It may be preferred that the composition comprises a non-ionic surfactant which is solid at temperatures below 30° C. or even 40° C., preferably present in an intimate mixture with other ingredients.

Essentially any alkoxylated non-ionic surfactants can also be comprised in the detergent compositions of the invention. The ethoxylated and propoxylated non-ionic surfactants are preferred. Preferred alkoxylated surfactants can be selected from the classes of the non-ionic condensates of alkyl phenols, non-ionic ethoxylated alcohols, non-ionic ethoxylated/propoxylated fatty alcohols, non-ionic ethoxylate/propoxylate condensates with propylene glycol, and the non-ionic ethoxylate condensation products with propylene oxide/ethylene diamine adducts.

Highly preferred are non-ionic alkoxylated alcohol surfactants, being the condensation products of aliphatic alcohols with from 1 to 75 moles of alkylene oxide, in particular about 50 or from 1 to 15 moles, preferably to 11 moles, particularly ethylene oxide and/or propylene oxide, are highly preferred non-ionic surfactant comprised in the anhydrous component of the particles of the invention. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3 or 5 moles, of ethylene oxide per mole of alcohol.

Non-ionic Polyhydroxy Fatty Acid Amide Surfactant

Polyhydroxy fatty acid amides are highly preferred non-ionic surfactants for use in the invention , in particular those having the structural formula $R^2CONR^1Z$ wherein: R1 is H, $C_{1-18}$, preferably $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ or $C_7$–$C_{19}$ alkyl or alkenyl, more preferably straight-chain $C_9$–$C_{17}$ alkyl or alkenyl, most preferably straight-chain $C_{11}$–$C_{17}$ alkyl or-alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated)

thereof. Z preferably will be derived from a reducing sugar in a reductive amination reaction; more preferably Z is a glycityl.

A highly preferred non-ionic polyhydroxy fatty acid amide surfactant for use herein is a $C_{12}$–$C_{14}$, a $C_{15}$–$C_{17}$ and/or $C_{16}$–$C_{18}$ alkyl N-methyl glucamide.

It may be particularly that mixtures of a $C_{12}$–$C_{18}$ alkyl N-methyl glucamide and a condensation product of an alcohol having an alkyl group containing from 8 to 20 carbon atoms with from 2 to 9 moles and in particular 3 or 5 moles, of ethylene oxide per mole of alcohol.

The polyhydroxy fatty acid amide can be prepared by any suitable process. One particularly preferred process is described in detail in WO 9206984.

Non-ionic Fatty Acid Amide Surfactant

Fatty acid amide surfactants or alkoxylated fatty acid amides include those having the formula: $R^6CON(R^7)(R^8)$ wherein $R^6$ is an alkyl group containing from 7 to 21, preferably from 9 to 17 carbon or even 11 to 13 carbon atoms and $R^7$ and $R^8$ are each individually selected from the group consisting of hydrogen, $C_1$–$C_4$ alkyl, $C_1$–$C_4$ hydroxyalkyl, and —$(C_2H_4O)_xH$, where x is in the range of from 1 to 11, preferably 1 to 7, more preferably form 1–5, whereby it may be preferred that $R^7$ is different to $R^8$, one having x being 1 or 2, one having x being from 3 to 11 or preferably 5.

Non-ionic Alkyl Esters of Fatty Acid Surfactant

Alkyl esters of fatty acids include those having the formula: $R^9COO(R^{10})$ wherein $R^9$ is an alkyl group containing from 7 to 21, preferably from 9 to 17 carbon or even 11 to 13 carbon atoms and $R^{10}$ is a $C_1$–$C_4$ alkyl, $C_1$–$C_4$ hydroxyalkyl, or —$(C_2H_4O)_xH$, where x is in the range of from 1 to 11, preferably 1 to 7, more preferably form 1–5, whereby it may be preferred that $R^{10}$ is a methyl or ethyl group.

Non-ionic Alkylpolysaccharide Surfactant

Alkylpolysaccharides can also be comprised in the anhydrous material of the particle of the invention, such as those disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Cationic Surfactant

Another preferred component of the compositions of the invention is a cationic surfactant, which is preferably be present at a level of from 0.1% to 60% by weight of the composition, more preferably from 0.4% to 20%, most preferably from 0.5% to 5% by weight of the composition.

When present, the ratio of the anionic surfactant to the cationic surfactant is preferably from25:1 to 1:3, more preferably from 15:1 to 1:1.most preferably from 10:1 to 1:1

The ratio of cationic surfactant to the stabilising agent is preferably from 1:30 to 20:1, more preferably from 1:20 to 10:1.

Preferably the cationic surfactant is selected from the group consisting of cationic ester surfactants, cationic mono-alkoxylated amine surfactants, cationic bis-alkoxylated amine surfactants and mixtures thereof.

Cationic Mono-alkoxylated Amine Surfactants

The optional cationic mono-alkoxylated amine surfactant for use herein, has the general formula:

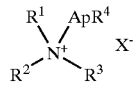

wherein $R^1$ is an alkyl or alkenyl moiety containing from about 6 to about 18 carbon atoms, preferably 6 to about 16 carbon atoms, most preferably from about 6 to about 11 carbon atoms; $R^2$ and $R^3$ are each independently alkyl groups containing from one to about three carbon atoms, preferably methyl; $R^4$ is selected from hydrogen (preferred), methyl and ethyl, $X^-$is an anion such as chloride, bromide, methylsulfate, sulphate, or the like, to provide electrical neutrality; A is selected from $C_1$–$C_4$ alkoxy, especially ethoxy (i.e., —$CH_2CH_2O$—), propoxy, butoxy and mixtures thereof; and p is from 1 to about 30, preferably 1 to about 15, most preferably 1 to about 8.

Highly preferred cationic mono-alkoxylated amine surfactants for use herein are of the formula

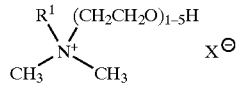

wherein $R^1$ is $C_6$–$C_{18}$ hydrocarbyl and mixtures thereof, preferably $C_6$–$C_{14}$, especially $C_6$–$C_{11}$ alkyl, preferably $C_8$ and $C_{10}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

Cationic Bis-alkoxylated Amine Surfactant

The cationic bis-alkoxylated amine surfactant for use herein, has the general formula:

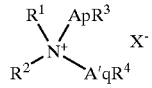

wherein $R^1$ is an alkyl or alkenyl moiety containing from about 6 to about 18 carbon atoms, preferably 6 to about 16 carbon atoms, more preferably 6 to about 11, most preferably from about 8 to about 10 carbon atoms; $R^2$ is an alkyl group containing from one to three carbon atoms, preferably methyl; $R^3$ and $R^4$ can vary independently and are selected from hydrogen (preferred), methyl and ethyl, $X^-$is an anion such as chloride, bromide, methylsulfate, sulphate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

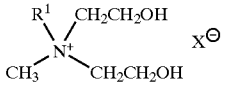

wherein $R^1$ is $C_6$–$C_{18}$ hydrocarbyl and mixtures thereof, preferably $C_6$, $C_8$, $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

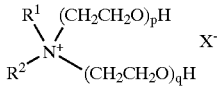

wherein $R^1$ is $C_6$–$C_{18}$ hydrocarbyl, preferably $C_6$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the particle of the invention or the compositions containing the particle of the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_{6-C18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Additional Detergent Ingredients

The detergent composition of the invention can comprise any additional detersive actives or ingredients known in the art. The precise nature of these additional components, and levels of incorporation thereof will depend on the physical form of the composition, and the precise nature of the washing operation for which it is to be used.

Other preferred ingredients comprise a perfume, brightener or dye or mixtures thereof, which may be sprayed onto the particular component herein.

The compositions of the invention preferably contain one or more additional detergent components selected from surfactants, bleaches, builders, chelants, (additional) alkalinity sources, organic polymeric compounds, enzymes, brightners, suds suppressors, lime soap dispersants, soil suspension and anti-redeposition agents and corrosion inhibitors.

Heavy Metal Ion Sequestrant

Heavy metal ion sequestrant are also useful additional ingredients herein. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Perhydrate Bleaches

Preferably the detergent compositions of the invention comprise oxygen bleach, preferably comprising a hydrogen peroxide source and a bleach precursor or activator. Since the present invention improves product delivery to the wash, it increases bleach efficiency and reduces the risk of fabric damage by bleaches present in the detergent.

A preferred source of hydrogen peroxide is a perhydrate bleach, such as metal perborates, more preferably metal percarbonates, particularly the sodium salts. Perborate can be mono or tetra hydrated. Sodium percarbonate has the formula corresponding to $2Na_2CO_3.3H_2O_2$, and is available commercially as a crystalline solid.

In particular the percarbonate salts are preferably coated. Suitable coating agent are known in the art, and include silicates, magnesium salts and carbonates salts.

Potassium peroxymonopersulfate, sodium per is another optional inorganic perhydrate salt of use in the detergent compositions herein.

Organic Peroxyacid Bleaching System

A preferred feature of the composition herein is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

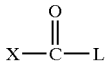

where L is a leaving group and X is essentially any functionality, such that on roloysis the structure of the peroxyacid produced is

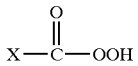

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N— or O—acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

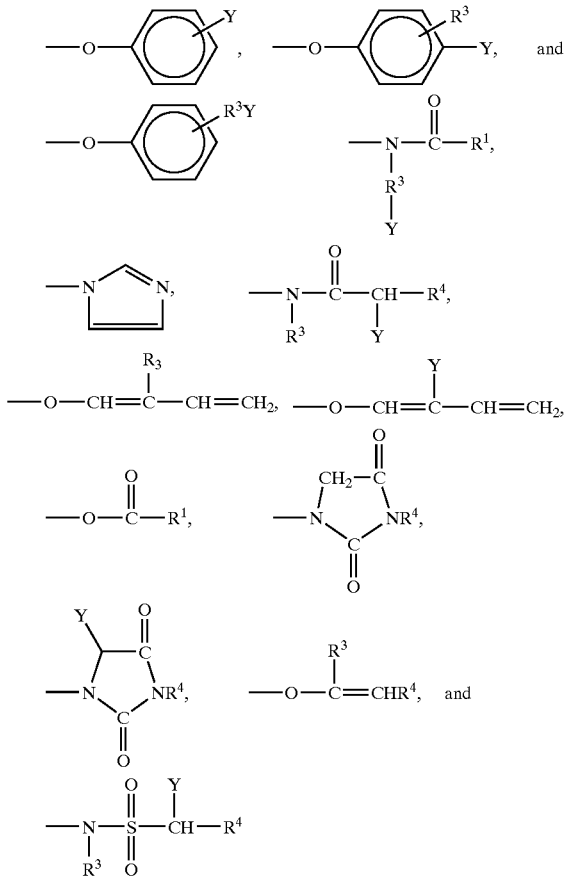

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1,2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Plkyl Peroxyacid Precursors

Amide substituted alkyl peroxyacid precursor compounds are suitable herein, including those of the following general formulae:

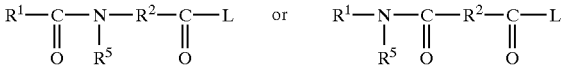

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

The detergent composition may contain, in addition to, or as an alternative to, an organic peroxyacid bleach precursor compound, a preformed organic peroxyacid , typically at a level of from 1% to 15% by weight, more preferably from 1% to 10% by weight of the composition.

A preferred class of organic peroxyacid compounds are the amide substituted compounds of the following general formulae:

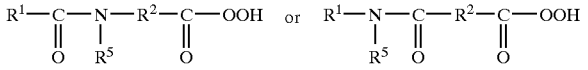

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Enzyme

Another preferred ingredient useful herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Organic Polymeric Compound

Organic polymeric compounds are preferred additional components of the compositions herein.

By organic polymeric compound it is meant herein essentially any polymeric organic compound commonly used as binder, dispersants, and anti-redeposition and soil suspension agents in detergent compositions, including any of the high molecular weight organic polymeric compounds described as clay flocculating agents herein, including quatemised ethoxylated (poly) amine clay-soil removal/anti-redeposition agent.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No.60/051517 .

Another organic compound, which is a preferred clay dispersant/anti-redeposition agent, for use herein, can be the ethoxylated cationic monoamines and diamines of the formula:

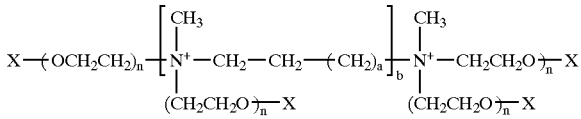

wherein X is a non-ionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72-78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DC0544, commercially available from DOW Corning under the tradename DC0544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners, as known in the art.

Polymeric Soil Release Agent

Polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the non-ionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the non-ionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo K K.

Additional classes of SRA's include: (I) non-ionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either non-ionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the compositions of the invention include perfumes, speckles, colours or dyes, filler salts, with sodium sulphate being a preferred filler salt. Also, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present. Highly preferred are encapsulated perfumes, preferably comprising a starch encapsulte.

In the compositions of the invention, it may be preferred that when dyes and/or perfumes are sprayed onto the another component, the component does not comprise spray-on non-ionic alkoxylated alcohol surfactant.

Form of the Compositions

The composition of the invention thereof can be made via a variety of methods involving the mixing of ingredients, including dry-mixing, compaction such as agglomerating, extrusion, tabletting, or spray-drying of the various compounds comprised in the detergent component, or mixtures of these techniques, whereby the components herein also can be made by for example compaction, including extrusion and agglomerating, or spray-drying.

The compositions herein can take a variety of physical solid forms including forms such as tablet, flake, pastille and bar, and preferably the composition is in the form of granules or a tablet.

The compositions in accordance with the present invention can also be used in or in combination with bleach additive compositions, for example comprising chlorine bleach.

The compositions preferably have a density of more than 350 gr/litre, more preferably more than 450 gr/litre or even more than 570 gr/litre.

Below are some examples of detergent compositions according to the invention.

ABBREVIATIONS USED IN EXAMPLES

In the detergent compositions exemplified below, the abbreviated component identifications have the following meanings:

| | |
|---|---|
| LAS | Sodium linear $C_{11-13}$ alkyl benzene sulfonate |
| LAS (I) | Flake containing sodium linear $C_{11-13}$ alkyl benzene sulfonate (90%) and sodium sulphate and moisture |
| LAS (II) | Potassium linear $C_{11-13}$ alkyl benzene sulfonate |
| MES | α-sulpho methylester of $C_{18}$ fatty acid |
| TAS | Sodium tallow alkyl sulphate |
| CxyAS | Sodium $C_{1x}$–$C_{1y}$ alkyl sulphate |
| C46SAS | Sodium $C_{14}$–$C_{16}$ secondary (2,3) alkyl sulphate |
| CxyEzS | Sodium $C_{1x}$–$C_{1y}$ alkyl sulphate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| SADS | Sodium $C_{14}$–$C_{22}$ alkyl disulfate of formula 2-(R).$C_4H_7$.-1,4-$(SO_4\text{-})_2$ where R = $C_{10}$–$C_{18}$ |
| SADE2S | Sodium $C_{14}$–$C_{22}$ alkyl disulfate of formula 2-(R).$C_4H_7$.-1,4-$(SO_4\text{-})_2$ where R = $C_{10}$–$C_{18}$, condensed with z moles of ethylene oxide |
| APA | $C_8$–$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{16}$–$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 (I) | Crystalline layered silicate of formula δ- $Na_2Si_2O_5$ of weight average particle size of 18 microns and at least 90% by weight being of particle size of below 65.6 microns. |
| NaSKS-6 (II) | Crystalline layered silicate of formula δ-$Na_2Si_2O_5$ of weight average particle size of 18 microns and at least 90% by weight being of particle size of below 42.1 microns. |
| Citric acid | Anhydrous citric acid |
| Borate | Sodium borate |
| Carbonate | Anhydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulphate | Anhydrous sodium sulphate |
| Mg sulphate | Anhydrous magnesium sulphate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |

-continued

| | |
|---|---|
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/US9703635 |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photoactivated bleach | Sulfonated zinc phthlocyanine encapsulated in or carried by soluble polymer or sulfonated alumino phthlocyanine encapsulated in or carried by soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | $bis((C_2H_5O)(C_2H_4O)_n)(CH_3)\text{-}N^+\text{-}C_6H_{12}\text{-}N^+\text{-}(CH_3)bis((C_2H_5O)\text{-}(C_2H_4O))_n$, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |

-continued

| | |
|---|---|
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |

Example 1

A detergent composition was formed comprising blown powder, an agglomerate comprising crystalline layered silicate and anionic surfactant, an effervescent particle and dry-mixed bleach activator particle, sodium percarbonate, sodium citrate and suds supressor.

The individual particulates were prepared and dry-mixed together with gentle mixing e.g. in a Nautamixer for a period of at least 4 minutes.

Preparation of the Blown Powder

The composition of the final blown powder was as follows:

| Ingredient | % in Blown Powder |
|---|---|
| Sodium Linear Alkyl Sulphonate (LAS) | 20 |
| Copolymer of Acrylic/Maleic Acid | 5 |
| Sodium Sulphate | 16 |
| Sodium Carbonate | 31 |
| Sodium Citrate | 20 |
| Water | 8 |

The blown powder was prepared by a standard spray drying process. The above ingredients were mixed into a slurry with water. The aqueous slurry may be prepared by a batch or continuous process. In this case, a batch mixer, or "crutcher" was used in which the various detergent components were dissolved in, or slurried with, water to provide a slurry containing 35% water. The water content my be varied from about 20% to about 60% by weight of water, preferably it is about from about 30% to about 40% by weight water. In this example the order of addition of the ingredients to water to form the aqueous slurry was as listed above in the final composition of the blown powder. The aqueous slurry was then pumped at high pressure through atomising nozzles into a spray-drying tower where excess water was driven off, producing a flowable powder product (blown powder). Fines were screened out through a mesh.

Preparation of Crystalline Layered Silicate/Anionic Surfactant Particle

An agglomerate comprising 70% SKS6 and 30% LAS was prepared by a conventional agglomeration process.

Preparation of the Effervescent Particle

Particles were prepared having the following composition:

| Ingredient | Composition % |
|---|---|
| Malic Acid | 44 |
| Sodium Bicarbonate | 40 |
| Sodium Carbonate | 16 |

The particle was made via a roller compaction process. The raw materials in the proportions indicated above, were fed at a press force of 80 kN into a Pharmapaktor L200/50 P roller, set up with concave smooth rolls with a 0.3 mm axial corrugation installed. The flakes produced were then compacted using a Flake Crusher FC 200 with a mesh size selected to produce the required particle size. The product was screened to remove the fines.

These three components were mixed with the additional dry-added ingredients listed below, in the proportions given below, to form a detergent composition according to the invention.

| Ingredient | % in Detergent Composition |
|---|---|
| Spray Dried | 42 |
| Bleach Activator | 3 |
| Sodium Percarbonate | 15 |
| Sodium Citrate | 10 |
| SKS6/LAS granulate | 10 |
| Suds supressor particle (95% PEG, 5% silicone) | 4 |
| Effervescent Particle | 16 |

Example 2

Further examples of detergent compositions of the invention are given as formulations A–D in the table below which also indicates the method of preparation of the examples.

| | A | B | C | D |
|---|---|---|---|---|
| Blown powder | | | | |
| LAS | 10.0 | 0.0 | 5.0 | 8.0 |
| TAS | — | 1.0 | — | 1.0 |
| MBAS | — | — | — | — |
| $C_{45}AS$ | — | — | — | — |
| $C_{45}AE_3S$ | — | — | — | — |
| QAS | — | — | | |
| DTPA, HEDP and/or EDDS | 0.3 | 0.3 | 0.3 | 0.3 |
| MgSO4 | 0.5 | 0.4 | 0.5 | 0.5 |
| Sodium citrate | 10.0 | 12.0 | — | — |
| Sodium carbonate | 15.0 | 8.0 | 10.0 | 7.0 |
| Sodium sulphate | 5.0 | 5.0 | 5.0 | 5.0 |
| Sodium silicate 1.6R | — | — | — | — |
| Zeolite A | — | — | 16.0 | 18.0 |
| SKS-6 | — | — | — | — |
| MA/AA or AA | 1.0 | 2.0 | 1.0 | 2.0 |
| PEG 4000 | — | 2.0 | — | 2.0 |
| QEA | 1.0 | — | 1.0 | — |
| Brightener | 0.05 | 0.05 | 0.05 | 0.05 |
| Silicone oil | 0.01 | 0.01 | 0.01 | 0.01 |
| Agglomerates | | | | |
| SKS-6 | 6.0 | 5.0 | 6.0 | 8.0 |
| LAS | 4.0 | 5.0 | 4.0 | 5.0 |

-continued

| | A | B | C | D |
|---|---|---|---|---|
| Dry-add particulate components | | | | |
| Maleic acid/ carbonate/bicarbonate (40:20:40) | 8.0 | 10.0 | 8.0 | 10.0 |
| QEA | — | — | — | — |
| NACAOBS | 3.0 | — | 3.0 | — |
| NOBS | — | 3.0 | — | 3.0 |
| TAED | 2.5 | — | 2.5 | — |
| MBAS | — | — | — | — |
| LAS (I) | 5.0 | 3.0 | 10.0 | 10.0 |
| Spray-on | | | | |
| Brightener | 0.2 | 0.2 | 0.2 | 0.2 |
| Dye | — | — | — | — |
| C24AE5 | — | — | — | — |
| Perfume | — | — | — | — |
| Dry-add | | | | |
| Citrate | 4.0 | — | — | — |
| Percarbonate | 15.0 | 3.0 | 15.0 | 3.0 |
| Perborate | — | — | — | — |
| Photobleach | 0.02 | 0.02 | 0.02 | 0.02 |
| Enzymes (cellulase, amylase, protease, lipase) | 1.5 | 0.3 | 1.3 | 0.3 |
| Carbonate | — | — | 0.0 | 10.0 |
| Perfume (encapsulated) | 0.6 | 0.5 | 0.6 | 0.5 |
| Suds suppressor | 1.0 | 0.6 | 1.0 | 0.6 |
| Soap | 0.5 | 0.2 | 0.5 | 0.2 |
| Citric acid | — | — | — | — |
| Dyed carboanate (blue, green) | 0.5 | 0.5 | 0.5 | 0.5 |
| SKS-6 | — | — | — | — |
| Fillers up to 100% | | | | |

What is claimed is:

1. A solid detergent composition comprising from 10 to 60 wt % of a surfactant system and having a maximum Residues Index of 25 and a maximum Secondary Residues Index of 15, said composition comprising:

(a) from 3% to 50% by weight of the composition of first particles comprising from 25% to 75% by weight of the particles of a partially water-soluble crystalline layered silicate builder and from 25% to 75% by weight of the particles of an alkyl benzene sulphonate surfactant, said partially water-soluble builder and said surfactant being intimately mixed;

(b) second particles comprising a water-soluble builder, said particles being present in an amount sufficient to provide from 1% to about 80% by weight of the composition of a water-soluble builder, said water-soluble builder being intimately mixed with a surfactant; and (c) the balance of the composition comprising a member selected from the group consisting of zeolites, bleaches, chelants, alkalinity sources, organic polymeric compounds, enzymes, brighteners, suds suppressors, lime soap dispersants, soil suspension agents, anti-redeposition agents and corrosion inhibitors, with the proviso that if zeolites are present they comprise less than 4% by weight of the composition.

2. A detergent composition according to claim 1 comprising non-ionic surfactant which has been sprayed onto pre-formed particulates comprising surfactant and solid carrier material.

3. A detergent composition according to claim 1 additionally comprising a cationic surfactant.

4. A detergent composition according to claim 1 which is substantially free of alkyl sulphate surfactant.

5. A detergent composition according to claim 1 comprising an effervescence component comprising an intimate mixture of substantially anhydrous stabilising agent and an effervescent system.

6. A detergent composition according to claim 1 further comprising a percarbonate bleach source.

7. A detergent composition according to claim 1 in the form of a detergent tablet.

* * * * *